United States Patent [19]

von Holst et al.

[11] Patent Number: 4,618,540

[45] Date of Patent: Oct. 21, 1986

[54] COMPOUND BODY AND METHOD OF MAKING THE SAME

[75] Inventors: Johan P. von Holst, Sandviken; Rolf G. Oskarsson, Rönninge, both of Sweden

[73] Assignee: Santrade Limited, Lucerne, Switzerland

[21] Appl. No.: 606,296

[22] Filed: May 2, 1984

[30] Foreign Application Priority Data

May 13, 1983 [SE] Sweden ..... 8302735

[51] Int. Cl.[4] ..... B22F 7/02; B22F 7/04

[52] U.S. Cl. ..... 428/552; 419/41; 419/67

[58] Field of Search ..... 428/545, 556, 558, 559, 428/554, 552, 548, 569, 561, 551, 610, 621, 627; 419/8, 13, 14, 15, 41, 67; 75/242, 246

[56] References Cited

U.S. PATENT DOCUMENTS

| | | | |
|---|---|---|---|
| 4,056,517 | 9/1977 | Saga | 75/242 |
| 4,082,559 | 4/1978 | Mishuku et al. | 75/242 |
| 4,145,213 | 5/1979 | Oskarsson et al. | 75/242 |
| 4,162,392 | 7/1979 | Brown et al. | 75/242 |
| 4,300,952 | 11/1981 | Ingelström et al. | 75/242 |

FOREIGN PATENT DOCUMENTS

| | | | |
|---|---|---|---|
| 407781 | 3/1934 | United Kingdom | 75/242 |

*Primary Examiner*—Allan M. Lieberman

*Attorney, Agent, or Firm*—Burns, Doane, Swecker & Mathis

[57] ABSTRACT

Wear parts or cutting tools, in which the part being exposed to wear is essentially an extremely difficultly grindable material (e.g., hard material), but in which the manufacture of the wear part or cutting tool requires considerable grinding operations can, according to the invention, be made better and cheaper forming the wear part or cutting tool of a compound material which is a wear-resistant (or difficult to grind) surface and a supporting surface of high speed steel or tool steel.

16 Claims, 13 Drawing Figures

FIG. 1
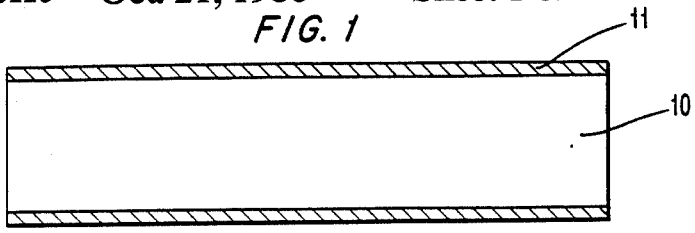
FIG. 2
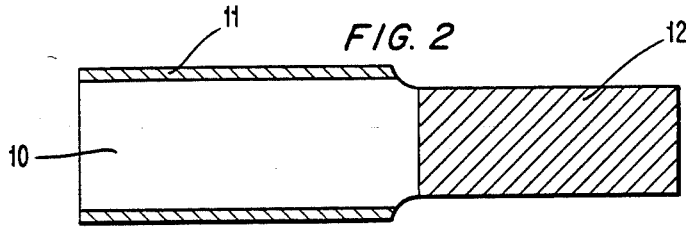
FIG. 3
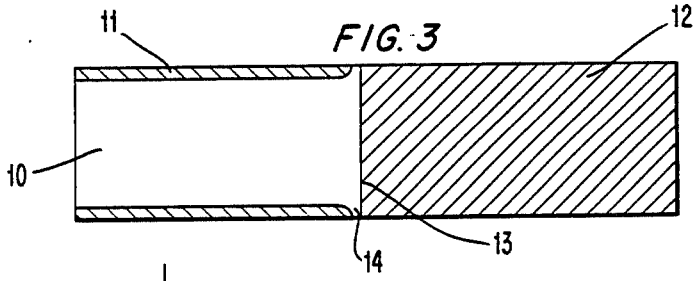
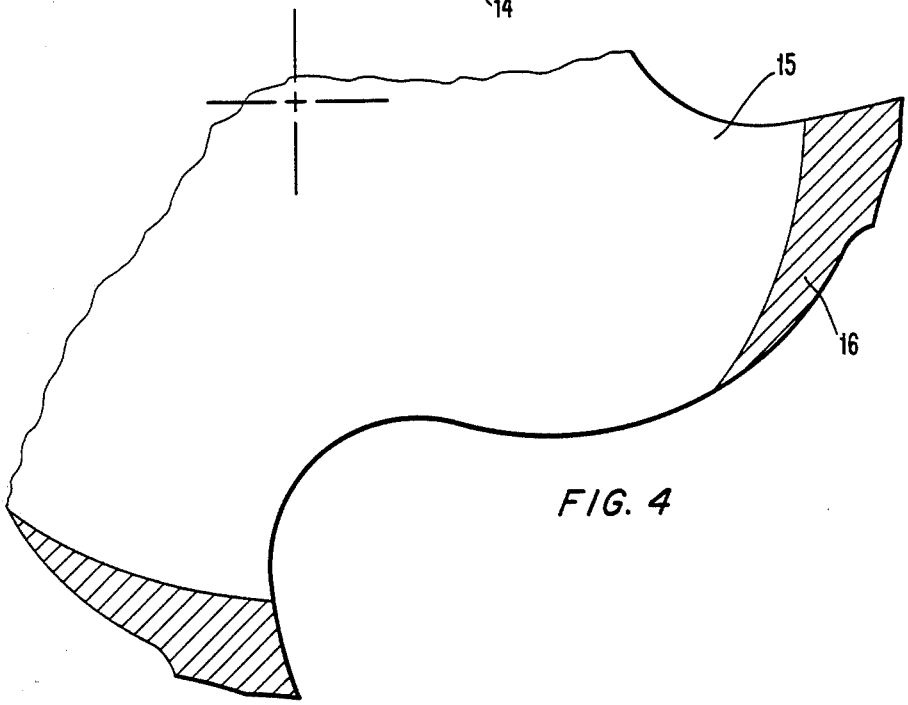
FIG. 4

FIG. 5
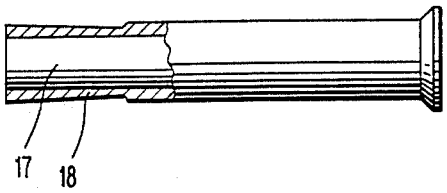
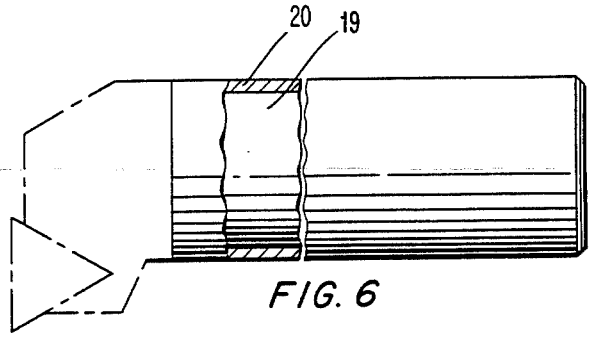
FIG. 6
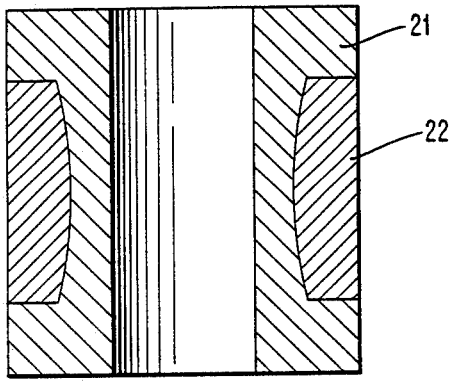
FIG. 7
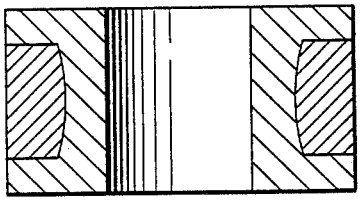
FIG. 8
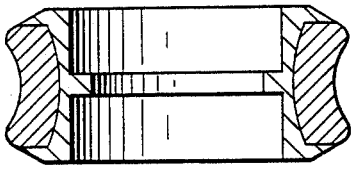
FIG. 9

COMPOUND BODY AND METHOD OF MAKING THE SAME

BACKGROUND OF THE INVENTION

The present invention relates to wear parts and cutting tools manufactured in an economical way from hard materials having smaller contents of hard principles than cemented carbide. In particular, the invention relates to tools consisting of elongated bodies such as shank end mills, broaches, threading tools, drills, shearing and punching tools (e.g., nibbling tools) holding tools such as boring or turning bars, etc. In regard to wear parts, the invention relates essentially to products for rolling mills and transport equipment—in which even mediatransport is included—such as rollers, rolls (e.g., entry guides, transport rolls, etc.) sleeves, bars, shafts and similar products, optionally provided with a center hole, compressor and pump parts, valves etc.

For a long time, it has been desired to make wear parts and cutting tools from material having properties between cemented carbide and high speed steel in an economically satisfactory way. Some such materials exist, as e.g., Ferro-TiC, carbide enriched powder high speed steel, material according to the Swedish Pat. No. 392.482, etc. Economic manufacturing methods have not been realized, however, and said materials have not shown the advantages expected.

Thus, materials such as e.g., Ferro-TiC has not proved successful. This is due to the large grain growth of the hard constituents which takes place during sintering, the high level of cost (being the same as that of cemented carbide because of the same technology) and the high costs of manufacturing.

The so-called particle metallurgical high speed steels can contain a relatively large amount of hard constituents compared to conventional high speed steels, which hard constituents are mainly in the form of vanadium carbide. The amount of hard constituents is limited, however, because of the precipitation of primary carbides from the melt in connection with granulation in inert gas (if there are high contents of vanadium and carbon), because of the machinability since a solid bar is machined with current methods and because of the grindability in making the final tools or wear parts. The particle metallurgical steels are prepared, as mentioned before, by granulation of a melt in inert gas. This process gives a spherical powder, which cannot be compacted to a green body, so the compaction must be done in a container which accompanies the material in the rest of the process. The advantage of the particle metallurgical steels is the low content of oxygen and the small grain size of the hard constituents in the range of 1–2 μm.

Powder metallurgical high speed steel is made via granulation of a melt in water. This process has the same limitation of the alloying content as that of the particle metallurgical steels. Water granulated powder gives good green strength. The powder can thus be used for pressing of shaped bodies which then are sintered to almost final shape. This process makes very great demands upon the sintering furnace and the method has therefore not been used very much. In addition, this process is unsuitable for the production of long, slender tools of the type mentioned above. Also, during sintering, grain growth of the hard constituents, particularly in the grain boundaries is easily obtained.

This grain growth will give an insufficient strength in the sintered body.

The practical limit when making cemented carbide is less than 20–25% by weight of binder phase. Even at these levels, there are problems with islands of binder phase formed after the sintering. These islands naturally do not have the hardness of the carbide phase. In the normal manufacture of cemented carbide, the sintering temperature is considerably higher than the temperature at which an alloy consisting of hard constituents (metal carbide particles)+binder phase melts. Consequently, all of the binder phase is melted and it has also dissolved a large amount of the hard constituents. A carbide skeleton remains, however. It is said skeleton which preserves the shape of the body. When there are too large amounts of the binder phase, the carbide skeleton is insufficient and the body loses its shape.

Extrusion is a method of working metallic material which gives possibilities of forming materials relatively difficult to work. The method is advantageously used e.g., in making seamless tubes of high alloyed stainless steel. The drawback of the method is its high cost. In attempts with alloys having extremely high amounts of hard constituents, it has been found that even a tungsten carbide-cobalt alloy having as high an amount of hard constituents as 80% by weight of WC, i.e. cemented carbide, can be warm extruded. Such an alloy has naturally a great resistance to deformation but is normally considered uneconomical to extrude because it causes too great a wear of the extrusion tools. The upper limit is about 25–30% by volume of hard constituents in materials being worked by means of forging, rolling and so on.

It has previously been considered difficult to co-extrude two materials having different resistances to deformation into a compound bar or compound tube. In our attempts to decrease the wear of the extrusion tools it has been found possible, however, to co-extrude a core of normal steel (solid or in powder form) with an outer cover of a powder body being extremely rich in hard particles. It has been found important that this compound body is enclosed in an extrusion can of carbon steel or stainless steel, useful in the very extrusion process and also in the following processes of manufacturing tools or wear parts. The steel core can consist of tool steel or high speed steel.

According to the preceding text, it is possible to extrude bar having up to 70% by volume of hard constituents (80% by weight of WC corresponds to 70% by volume of WC). The hard material according to the present invention relates to alloys in the intermediate range, i.e., 30–70% by volume of hard constituents. The hard constituents consist essentially of carbides and nitrides and the intermediate forms of the metals Ti, Zr, Hf, V, Nb, Ta, Cr, Mo, and/or W. Also, hard particles other than carbides and nitrides such as oxides, borides, silicides, etc., may be present. The matrix of the hard material consists of Fe-, Ni- and/or Co-based alloys. Preferably, the matrix of the hard material is based upon iron.

In the manufacture of long, slender tools, such as shank end mills and drills, twisted or straight (axial) flutes are ground in a cylindrical blank. Even at moderate flute depths a long contact curve is formed between the work piece and the grinding wheel. If said contact curve is too long in a material which is difficult to grind, the surface easily burns because the cooling is insufficient and the tendency of smearing is great. The only ways of decreasing the risks of burning is either decrease the removal rate or to use a softer wheel which itself wears quicker and when worn does not maintain the desired profile. The length of the contact curve, b, is about proportional to the source root of $\phi_s \cdot a$ in which $\phi_s$ is the diameter of the grinding wheel in mm and a is the actual grinding depth. In a normal shank end mill with a diameter of 20 mm, the flute depth is greater than 4 mm which gives a contact curve of about 40 mm. This means very long grinding times in a difficultly ground material if burning is to be avoided. At the same time, we know that in many applications the cutting tool material is used only in peripheral cutters. In those cases where central cutting edges are used, the cutting speed on those edges are lower than that on the outer edges which is why the demands upon wear resistance and toughness for each of these edges also are different.

SUMMARY AND ADVANTAGES OF THE INVENTION

In accordance with the present invention, there is provided a compound body of at least two parts, one of said at least two parts being a wear-resistant surface consisting essentially of a hard material of from 30 to 70 volume percent of particles of carbides, nitrides and/or carbonitrides of Ti, Zr, Hf, V, Nb, Ta, Cr, Mo and/or W, in a matrix based on Fe, Ni and/or Co and another of said at least two parts being a supporting surface consisting essentially of high speed steel or tool steel.

Also, there is provided a method of making a compound body characterized in that a body of high speed steel or tool steel is placed in a powder mixture consisting of 30 to 70 by volume of hard constituents formed by compounds of C, N, O, B, and/or Si with Ti, Zr, Hf, V, Nb, Ta, Cr, Mo, and/or W in a matrix based on Fe, Ni and/or Co, after which the body and the powder mixture are compacted by cold isostatic pressing to form an extrusion billet, which then are placed in cans and hot extruded to compound body blanks.

In addition, there is provided a method of making a compound body characterized in that a body of steel powder is made by cold isostatic compaction and that the body or a solid steel body is placed in a cold isostatic tool where the remaining space is filled with a powder mixture consisting of 30 to 70% by volume of hard particles in a matrix based on Fe, Ni and/or Co after which the body and the powder mixture are compacted by cold isostatic compaction to forgings which are forged to compound body blanks.

By means of the present invention, it has been found possible to make products having such performance capabilities as if they consisted merely of an alloy being rich in hard constituents. This result is obtained at an essentially lower cost of manufacturing thanks to the easy grinding of the products.

This leads to a great economic advantage which has become possible because conventional, cheap, ceramic abrasive wheels can be used at grinding conditions which are normal for high speed steel. Thus, because of the small length of the contact curve for the wear-resistant material, which is difficult to grind, the wheel does not "feel" the difficult material which if ground in solid form would mean burnings, great consumption of grinding wheels and uneconomical grinding conditions in general.

The following advantages are obtained:

1. The contact curve in the difficultly, wear-resistant ground material is decreased when the surface material is ground through.

2. A smaller amount of the material of the wear-resistant, difficult to grind material, is ground away.

3. The chip thickness is essentially greater than zero in the surface material, when this is ground through, which is favorable in view of the wear of grinding wheels.

4. The cutting forces are smaller as a consequence of 1–3.

5. Harder abrasive wheels, which maintain the profile better, can be used.

6. The more easily ground, supporting surface, material has a cleaning effect on the grinding wheel.

DESCRIPTION OF THE DRAWINGS

The invention will be described more in detail by the following specification and drawings which show:

FIG. 1, compound material blank, longitudinal section;

FIGS. 2 and 3, compound material blank with welded shaft, longitudinal section;

FIG. 4, shank end mill, cross section;

FIG. 5, nibbing tool, longitudinal section;

FIG. 6, boring bar, longitudinal section, schematic fig;

FIGS. 7–13, manufacturing of compound blanks and billets, examples.

DETAILED DESCRIPTION OF THE INVENTION

Figure 10:
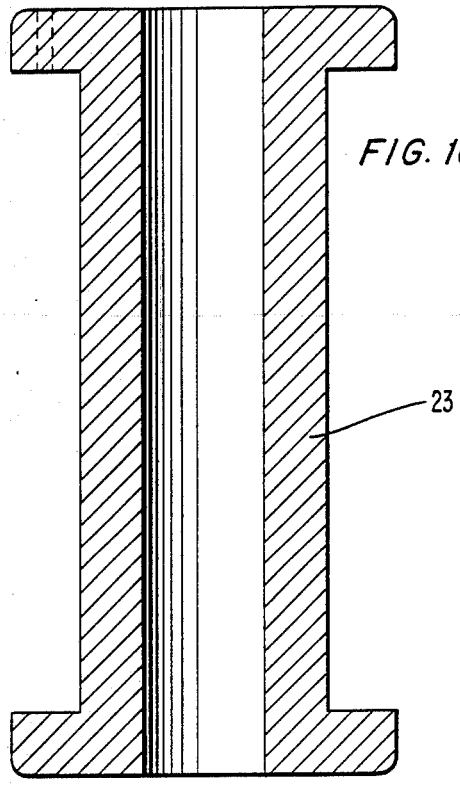

The material of the supporting surface has generally a grindability which is at least six times better than the corresponding grindability of the wear-resistant material. It is also suitable to compare the grindability of the compound body with the grindability of the hard material itself. It has been found that the grindability of the compound material and of only the hard material, respectively, measured in relative wear of grinding wheels, is usually greater than 5 and smaller than 1, respectively. In general, the grindability of the compound body (given in obtainable rate of material removal) is greater than 10 $mm^3$/mm, s.

In a compound body with the hard material as an outer, wear-resistant surface, the core or supporting surface shall naturally not have any greater content of alloying elements than is required in the final tool or wear part. In broaches and thread taps, as examples, a relatively low alloyed steel is sufficient because the core in such case does not perform cutting work. A drilling shank end mill or a twist drill, however, make considerably greater demands upon the core as a tool material, so that a high speed steel is more suitable.

By choosing the right material, the cost of the tool or wear part is influenced to a great extent.

As mentioned earlier, the present invention also relates to wear parts, essentially for machinery such as rolling mills and transport equipment, in which cemented carbide either is too expensive or does not have sufficient technical advantages (or even disadvantages such as too great a density in view of needed acceleration of transport rolls or similar products) and in which conventional wear resistant materials such as high speed steel (conventional particle metallurgical or powder metallurgical) have insufficient wear resistance. By using our new compound technique—which does not suffer from the limitations of existing manufacturing methods—products having economical and technical advantages can be prepared.

Surprisingly, as earlier mentioned, it has been found possible to compact alloys being rich in hard constituents and having a content of hard particles up to the cemented carbide range together with a material being less rich in hard constituents and therefore tougher by means of plastic working to produce compound products having full density and a good adherence between the two materials. The purpose of the invention is mainly to use plastic workingg but there are examples in which sintering has been used instead. The part having a smaller content of hard constituents can from the beginning be a solid material.

The preferred methods of compaction being are powder forging, and extrusion. In powder forging a compound preform is first made via cold pressing (generally isostatically) after which said preform is heated in a furnace having a protective gas atmosphere and then forged by means of simple forging tools. In this way a formed body is obtained which by simple methods can be manufactured into a final product. Heat treatment leading to desired properties is included in the manufacturing process.

When extrusion is used, an extrusion billet is first made by cold isostatically pressing. It has been found that by newly developed advanced filling technique two or more different powders can be filled simultaneously in a cold isostatic pressing tool by placing sleeves, which separate the various powders spaces, into the pressing tool. The sleeves can be removed by careful withdrawal after the completion of the powder filling. Alternatively, the forms can be sliding forms which are withdrawn to the same extent as the increase of the powder level, thus not influencing the borders between the different types of powder. By the mentioned methods, a satisfactory bond between the different materials is obtained after extrusion. It has also been surprisingly found that components having no or a small enrichment of hard constituents can be in the form of a solid material at the cold pressing step. It is possible, for example, to use a solid core of steel, which gives improved centring and better yield of material in the following extrusion process, and fill the remaining space in the cold pressing tool with hard material-enriched powder. After extrusion of the coldpressed extrusion billet, a satisfactory bond between the different materials is obtained. This has been examined in a test where the adherence of the core was tested in a special punching tool in which it was tried to push out the core while simultaneously measuring the forces. The forces were found to be on the same level as when two powder materials had been compacted simultaneously.

By extrusion, a compound bar is obtained in which the enrichment of hard constituents lies in zones according to the placing of the powder in the extrusion blanks and the design of the extrusion die. From this bar, product blanks are made by cutting.

Among the products provided with holes which can be manufactured from the preforms described above may be mentioned: rolls, guide rolls, transportation rolls, wearing rolls, wearing sleeves, compressor and pump parts etc. The advantages in making these products by the present invention are, for example, lower material costs, lower manufacturing costs and greater strength, because the more wear resistant and thus more brittle material, is supported by a tougher component.

A great number of rolls of various dimensions exist on the market. The standardisation is particularly bad concerning hole dimensions and bearing form. By making a blank without a central hole but in which the material to be removed consists of an easily worked steel, the stocks of intermediate products can be reduced as well as the number of tools needed for the compaction. For products made in a long production run, it is naturally suitable to have a preform provided with a hole. The costs of the tools are here justified by the lower working costs.

Rolls for cold rolling which do not have a central hole are suitably made from an extruded compound bar of the present invention. This is also applicable to shafts which are exposed to great wear.

Shafts with wearing surfaces such as different kinds of camshafts, can be made from a compound bar of the present invention which can be provided with internal lubricating channels by boring. By making a small hole at a suitable place, it is possible to obtain the lubrication at desired places.

An interesting application of a bar having a wear resistant surface and a very tough core is prison bars or similar protection equipment, as well as gratings or the like used in transportation or conveying of wearing abrasive materials, in which rubber linings or the like are unsuitable because of increased temperature and so on.

The compound material blanks shown in FIGS. 1–3 consist of a core or supporting surface 10 of a tough and easily ground material such as tool steel or high speed steel and a cover or wear-resistant surface 11 consisting of a material containing 30–70% by volume of hard particles in the form of carbides, nitrides and/or carbonitrides of Ti, Zr, Hf, V, Nb, Ta, Cr, Mo, and/or W in a matrix based upon Fe, Ni, and/or Co. The cover or wear resistant surface 11 preferably consists of an alloy having 30–70% by volume of hard particles consisting of titanium nitride in a matrix of high speed steel type (and the carbide types normally present therein) in which the enriched hard particles have a grain size $<1$ $\mu$m, preferably $<0.5$ $\mu$m.

The compound material blank shown in FIGS. 2 and 3 is provided with a shaft 12 of steel or similar metal or metal alloy compound blank is attached to the shaft by means of welding, for example frictional welding. Because a material rich in hard particles in general is practically impossible to weld against such a steel shaft, considerable improvements have been obtained by the invention also in this respect. With the use of a weldable core or cover supporting surface material, wear parts and tools made according to the present invention can be welded with good results to various kinds of steel shafts and similar materials. This fact saves material costs and gives technical advantage such as bending strength etc. In a welded butt joint 13 (see FIG. 3) between a tool according to the invention and a shaft of steel it has been found, quite surprisingly, that a transition zone 14 consisting of core material is usually obtained between the cover 11 and the shaft 12. This implies that the cover 11 is not welded directly to the shaft 12. Provided that the binding is good between the cover 11 and the core material 10—which can be obtained by the used method—and the core material is weldable to the shaft, an excellent welded joint is always obtained.

Blanks made according to FIG. 3 are particularly suitable for products such as shank end mills, broaches, thread taps, drills, reamers etc. By this principal design, the cutting properties of the core supporting surface and the wear-resistant cover materials can give optimum properties of the final product at a very low relative cost.

In a shank end mill, a portion of which schematically shown in FIG. 4, the major part of the milling cutter body consists of a core material 15, while all the active part of the cutters consists of the wear resistant material 16. Because of the great contact area between cover and core material, a very good adherence is obtained. The thickness of the cover material is adapted to the requirements upon regrinding.

The nibbling tool, shown in FIG. 5, consists to the greater part of a tough core material 17 and a surrounding cover of the wear resistant material 18. The shaft can consist of the compound material or the present invention or other suitable shaft material fixed to the compound material.

In FIG. 6 there is shown an example of a holding tool/boring or turning bar/in which the greater part of the tool consist of a tough supporting surface core material 19, which usually can easily be machined, surrounded by the stiffness-determining wear-resistant cover 20, in which the high modulus of elasticity of the material rich in hard principles, gives the tool a great stiffness and a high natural frequency.

In general the thickness of the wear-resistant cover is at least 0.5 mm and preferably at least 1 mm. Generally, the thickness of the cover is 3–50, usually 10–20, % of the radial dimension of the product.

The manufacture of blanks according to the invention is generally done as said before by co-extrusion of wear-resistant material and the supporting surface material. A body of high speed steel or tool steel is placed in a powder mixture consisting of 30–70% by volume of hard constituents formed by compounds of C, N, O, B, and/or Si with Ti, Zr, Hf, V, Nb, Ta, Cr, Mo, and/or W in a matrix based upon Fe, Ni, and/or Co. The steel body and the powder mixture are then compacted by means of cold isostatic pressing to extrusion billets which are placed in cans. Hot extrusion is thereafter performed at a temperature of 1100°–1250° C. to blanks which then are processed to final shape.

In certain applications, a compound of three or more layers can be advantageous. The innermost core may consist of a simple high speed steel having low contents of alloying elements. Around this core a transition layer of a higher alloyed high speed steel having better wear resistance and resisting higher cutting speed may be applied. Outermost, a cover of a hard material having more than 30% hard consistuents may be placed. There are several advantages of such a combination of materials. For example an increased ability to resist higher cutting speeds and higher wear in the direction from the center is obtained as well as more continuous transition between materials having different thermal expansion. The least alloyed high speed steel has the greatest and the hard material enriched alloy has the smallest thermal expansion. In this way, a better state of strain is obtained in the finally compacted material. The conditions at a cutting edge regarding the formation of so called built-up edges and the ability to resist dislodging of such edges can also be influenced in a positive fashion.

All the variants above can also advantageously be provided with a thin layer of hard coating.

In the following description, there are first Examples 1–13, which show various conditions used in the manufacture of cutting tools, essentially tool blanks, and results which have been obtained in working and testing of tools according to the invention. After that, Examples 14–22 show various conditions used in the manufacture of blanks for wear parts according to the invention.

EXAMPLE 1

An alloy with 80% by weight of WC and 20% by weight of Co was milled in a conventional way in a cemented carbide mill using milling bodies of cemented carbide and alcohol as milling liquid. The dried powder was pressed to round bodies which were presintered at 900° C. in hydrogen. The bodies were placed in cans of stainless steel being evacuated before they were sealed. After heating to 1170° C., 45 min, the cans were extruded to bars $\phi$ (diameter) 14 mm from the start dimension $\phi$ 47 mm. (The billet cylinder of the extrusion press was $\phi$ 50 mm). A pressure force of 240 tons was used, which gives a deformation resistance of 50.6 kg/mm$^2$. The extruded alloy had a hardness of 1160 HV. When the same powder was sintered in a conventional "cemented carbide way", an alloy having the hardness 950 HV was obtained. The difference in hardness depends upon the fact that extruded material has a grain size of $<1$ $\mu$m, while the sintered material has a grain size of about 3 $\mu$m.

EXAMPLE 2

By conventional milling in a cemented carbide mill in the same way as in the foregoing example, an alloy consisting of 27% by weight of TiC, 67% by weight of Ni and 6% by weight of W was prepared. First a bar, $\phi$ 38 mm, was extruded from a can $\phi$ 120 mm (the billet cylinder of the extrusion press being $\phi$ 125 mm). This solid, homogeneous bar was placed in a new can with dimensions according to preceding example. After heating to 1150° C., 45 min, a bar, $\phi$ 16 mm, was extruded, extrusion ratio 9. The pressure force was 180 tons.

EXAMPLE 3

A high speed steel powder, prepared according to the so called "Coldstream process" to a mean grain size of about 10 $\mu$m, of type M41 (1.15% C, 6.75% W, 4.0% Mo, 4.2% Cr, 2.0% V, 5.0% Co) was mixed with vanadium carbide, grain size 4 $\mu$m. The amount (ratio) was 60% by weight of high speed steel powder and 40% by weight of VC. After milling in a cemented carbide mill and drying, extrusion billets were pressed cold isostatically at 200 MPa. The dimension of the billets was $\phi$ 68–69 mm, length 240 mm in order to fit into extrusion cans $\phi$ 76 mm with wall thickness 3 mm. (The billet cylinder of the extrusion press was $\phi$ 80 mm). The cans were evacuated during heating to 600° C., after which they were sealed. After heating at 1150° C., 45 min, bar $\phi$ 24 mm was extruded. Samples were taken from the extruded bar and used in heat treating tests (hardening+annealing). It was found that the hardness 72 HRC should not be exceeded if the material is to be used as cutting tools. It would be too brittle and give chippings in the cutting edge. Thanks to the low extrusion temperature, the fine grain size from the milling is maintained and a sharp cutting edge can be made. Thus, vanadium carbide is very inclined to grain growth during a sintering operation, because it is situated relatively high in the free-energy-diagram. In certain applications, for example punches and plungers, a larger grain size can be preferable. By heat treatment at high temperature desired grain growth can simply be obtained.

EXAMPLE 4

A powder mixture of 50% by volume of sub micron hard particles, essentially TiN, and a steel matrix with total composition 24.5% Ti, 7% N, 0.6% C, 7.5% Co, 6% W, 5% Mo, 4% Cr and the remainder Fe (and normally present alloying elements and impurities) was compacted cold isostatically at 200 MPa to extrusion billets with the same dimensions as in the proceeding example. Also the other process steps were identical as the far as extruded bar $\phi$ 24 described above. By various heat treatments, the material could obtain hardness values between 66 and 71 HRC. By the maintained fine grain size the material was very hard also in "soft annealed" condition, 63–64 HRC.

EXAMPLE 5

50% by weight of a brittle prealloy with the composition 56Cr-8W-34Co-2C which may be regarded as some kind of "sigma phase", was crushed by conventional crushers first jaw crusher and then cone crusher, down to a grain size of <2 mm. Then, milling was done for 10 h in a conventional cemented carbide mill, after which 50% by weight of Co powder has added and the mixture was milled for another 10 h. After drying and powder treatment in a conventional "cemented carbide way", extrusion billets were pressed cold isostatically at 200 MPa. These billets were extruded after heating at 1200° C., 1 h, to bar $\phi$ 20 mm. The composition of the product corresponds to cast alloys, for which the trade name has given the material its designation, viz. Stellite.

EXAMPLE 6

Compound billets were pressed of water granulated high speed steel powder type M2 (1.15% C, 4.0% Cr, 5.0% Mo, 6.5% W, 2% V, 0.2% O) in the core and "TiN-enriched high speed steel powder" according to Example 4 in the cover. The pressing was done cold isostatically at 200 MPa. Core diameter $\phi$ 47–48 mm, outer diameter $\phi$ 68–69 mm, length 300 mm. After the pressing the billets were vacuum annealed at 1200° C. for 2 h before they were put in extrusion cans of carbon steel. The heating was done at 1150° C. for 45 min. Round bar $\phi$ 14–$\phi$24 mm was extruded. The extruded bar $\phi$=24 mm incl can was cut in suitable lengths (40 mm) after which shaft material in SS 2090, length 65 mm, was friction welded to the compound bar. The welded blank was turned to desired dimension. After that the final tool blank was heat treated to suitable hardness (hardening+annealing). From the final blank a shank end mill $\phi$ 20 mm was ground having a geometry according to DIN 844.

Flute grinding data:
Abrasive wheel: ceramic grain mixture
Cutting fluid: oil
Wheel speed: 80 m/s
Total flute depth: 4.3 mm
Flute length: 50 mm
Effective removal rate: 9 $cm^3$/min Remaining grinding was performed with small removal according to high speed steel standard.

Tests were performed as upmilling with cooling in steel SS 2541 using an axial cutting depth of 10 mm and a radial cutting depth of 18 mm. At a tooth feed of 0.056 mm/tooth in the speed range 20–40 m/min there was obtained 4–6 times longer life than for a corresponding shank end mill (the same geometry) being made from a solid bar of conventional high speed steel type T42. The criteria of wear was a flank wear of 0.3 mm. The shank end mill according to the invention gave also a better surface on the workpiece, $R_a$ 1.0 $\mu$m to be compared with 3.2 $\mu$m for the conventional tool. The end mill according to the invention had then removed four times more material than the conventional tool.

EXAMPLE 7

50% by weight of NbC (density 7.74 g/$cm^3$) and 50% by weight of Coldstream-treated high speed steel type M41 was milled as conventional cemented carbide. After drying, extrusion billets were pressed cold isostatically at 200 MPa consisting of a core of water granulated high speed powder type M2 (1.1% C, 4.0% Cr, 5.0 % Mo, 6.5% W, 2% V, 0.2% O) $\phi$ 47–48 mm and a cover of the earlier mentioned NbC-enriched M41-powder, $\phi$ 68–69 mm. There were no problems in extruding bar $\phi$ 14–24 mm.

EXAMPLE 8

Conventional cemented carbide powder with 26% by weight of Co and 74% by weight of WC but without lubricant was used in making compound extrusion billets consisting of a core $\phi$ 47–48 of water granulated high speed steel powder, type T42 (1.5% C, 4.0% Cr, 3.1% Mo, 9.0% W, 9.0% Co, 3.1% V, 0.2% O) and a cover of the above mentioned cemented carbide powder $\phi$ 68–69 mm. The billets were placed in carbon steel cans $\phi$=76 mm with 3 mm wall thickness and extruded after heating to 1175° C. for 45 min to round bar $\phi$ 24 mm.

EXAMPLE 9

A core $\phi$ 24–25 mm of water granulated M2-powder, an intermediate layer of water granulated T 42 powder with $\phi$ 47–48 mm and a cover layer of "TiN-enriched high speed steel powder" according to Example 4 with $\phi$ 68–69 mm was pressed cold isostatically at 200 MPa. Annealing and extrusion were performed in the same way as in Example 6.

EXAMPLE 10

In a deepgrinding test, blanks according to the invention with the dimensions of $\phi$ 10 mm having core material of high speed steel M2 and a cover material according to Example 4 with a thickness of about 1 mm were ground.

Grinding data:
Abrasive wheel: Boron nitride
Cutting fluid: Oil
Wheel speed: 90 m/s
Flute depth: 4 mm
Flute length: 100 mm
Removal rate: 6 $cm^3$/min The action of heat of the cover material was very small.

At the same time blanks of solid material (from the same charge as the cover material in the compound blank) were ground. At the same grinding data, cracks and failures were observed in all samples.

EXAMPLE 11

In a flute grinding test in a swing frame grinder with compound material according to the invention, flutes for a 20 mm shank end mill were ground by ceramic grinding wheels (grinding data according to Example 6) at a removal rate corresponding to $\frac{2}{3}$ of that being normal for high speed steel. This is much better than what could be obtained with a blank of solid hard material in the same operation. The removal rate was increased about 10 times to attain the same results.

EXAMPLE 12

Friction welding tests were performed in a machine using compound blanks according to the invention and solid blanks of the corresponding hard material, welding said materials to steel, SS 2090. Welding data: Friction pressure 106 MPa, forging pressure 230 MPa and total welding time 10 s. All tests with solid hard material failed while blanks according to the invention could be welded to the steel holder with good results.

EXAMPLE 13

In order to examine the adherence of the cover material to the core material, plain shank end mills, 20 mm, according to the invention were tested with the following data:

Axial cutting depth: 20 mm
Radial cutting depth: 2 mm
Feed: 0.089 mm/tooth
Cutting speed: 35 m/min
Work piece material: Steel SS 2343

The tests were performed with and without cutting fluid until the wear was so great that the cutting forces led to breakage of the shafts of the end mills. In no case was there noted any non-adherence of the cover material from the core material despite the violent treatment.

EXAMPLE 14

In order to make a guide roll of compound type, a preform of the "cotton reel" type was first pressed cold isostatically by "wet bag" technique from steel powder 21, see FIG. 7. This preform was then placed in the next "wet bag" tool and hard material powder 22 of a high speed steel matrix and 30% by weight of submicron titanium nitride was charged, after which another cold isostatic pressing was done. The compound preform obtained was heated in a furnace with protective gas atmosphere to 1130° C. after which it was forged by one stroke to a preform according to FIG. 8. The pressure needed to make a dense body was 1000–1200 N/mm$^2$. Immediately after the forging, the roll blank was placed in a furnace at 875° C. and using protective gas atmosphere. After finished forging, the furnace was maintained at temperature for 6 hours after which it cooled in a controlled way 10° C./h down to 600° C. and then freely. From the blanks, entry guide rolls were prepared by the steps roughing—heat treatment (hardening+annealing)—finishing, leading to a final product according to FIG. 9.

EXAMPLE 15

In making extruded compound bars, from which wear rollers were manufactured, a solid core of steel was placed in the centre of a cold isostatic pressing tool. The composition of the steel was 0.35% C, 0.25% Si, 0.75% Mn, 3% Cr, 0.7% Mo, 0.3% V rest Fe. The remaining space of the pressing tool was charged with powder consisting of 50% by volume of submicron titanium nitride and 50% by volume of a heat treatable steel matrix. An extrusion billet with the diameter 260±1 mm was pressed at 200 MPa. The billet was placed in an extrusion can of carbon steel having the outer diameter 272 mm and a wall thickness of 5 mm. A cap having an evacuation tube was welded on.

The total length of the extrusion billet including cap and bottom was 1000 mm. The billet was heated during evacuation. The evacuation tube was sealed close to the billet and cut after which heating to 1150° C. took place. The extrusion press used had a billet cylinder $\phi$ 280 mm. The billet was extruded to $\phi$ 65 mm. From the obtained compound bar, roller blanks were cut after soft annealing by means of an electroerosive band cutter. The roller blanks were machined in a NC-machine, mainly to remove the carbon steel can on the wear surface, making a center hole and bearing positions.

EXAMPLE 16

In making an extruded compound bar, from which wear rollers were manufactured, a cold isostatic pressing tool was filled simultaneously with steel powder in the core and hard particle rich powder with about 50% by volume of hard principles in the peripheral part. The powders were separated by a thin walled sleeve which then was removed carefully. In this way there was an intermediate mixed zone (which after the extrusion was measured to be about 40 $\mu$m). An extrusion billet with the diameter 69±1 mm and the length 215 mm was pressed at 200 MPa. The billet was placed in an extrusion can with the outer diameter 76 mm and the wall thickness 3 mm. After sealing according to the foregoing example and heating to 1150° C. the billet was placed in an extrusion press with billet cylinder $\phi$ 80 mm. A round bar $\phi$ 28 mm was extruded in which the protecting can after the extrusion had a wall thickness of 1.0–1.5 mm. By cutting in an electroerosive band cutter blanks suitable for manufacturing of various small rollers were obtained.

EXAMPLE 17

In connection with the manufacture of compound bar according to the preceding example, a test with inert gas granulated powder was performed. Such powder is spherical and it does not give a green body with sufficient strength after cold isostatic pressing, but must be handled in a container. By placing our hard material enriched powder as "bottom" (and also as "top cover") a billet with sufficient green strength could be made. (Without our hard material enriched powder as the bottom the spherical powder would run out after cold isostatic pressing.) A compound bar $\phi$ 26 mm having good strength in the transition zone between the two materials was extruded. The adherence strength was tested by the method described earlier.

EXAMPLE 18

In tube extrusion, there is used a hollowed billet which is extruded over a mandrel. It is possible to cold isostatically press a hollowed compound billet by having a steel core in the pressing tool. (In principle, the same procedure as in Example 15 but carefully removing the core after the pressing.) Naturally the extrusion can will be more complicated and expensive as it has to be "double walled". The various powders are filled simultaneously in the same way as described in earlier examples having the hard material powders outermost. After cold isostatic pressing, the core was removed carefully and the hollowed billet was placed in a protecting can. This was treated as described earlier and the extrusion was done in usual ways but performed over a mandrel. A canned compound tube with 50% by volume of hard constituents in the outer layer was obtained.

EXAMPLE 19

A test was performed in the same way as in Example 18 but placing the hard material-rich powder innermost. At extrusion, a compound tube was obtained from which wearing sleeves were manufactured.

EXAMPLE 20

Figure 11:
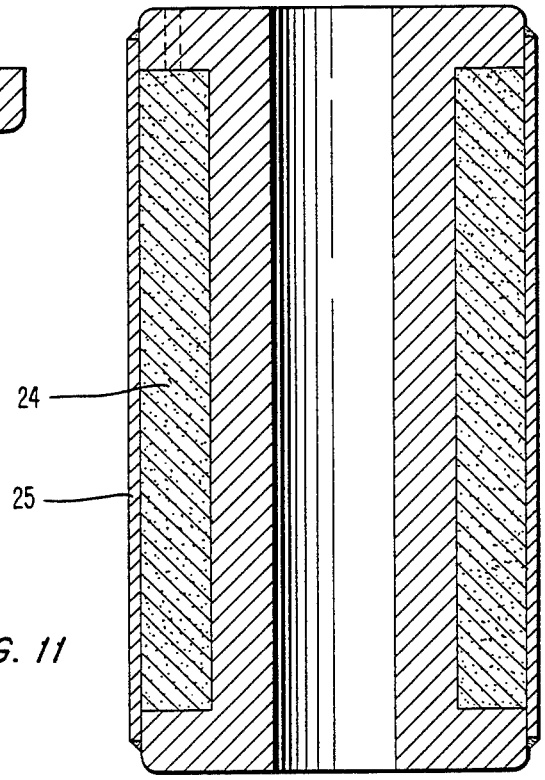

Compound tubes were produced by making a solid preform 23 of steel according to FIG. 10. This preform was placed in a form of polyurethane and hard material powder 24 was charged (see FIG. 11). After cold pressing, an external protecting tube 25 was welded so that an extrusion billet was obtained. The billet was treated in the usual way and compound tubes were extruded from which wear rollers were manufactured.

EXAMPLE 21

Figure 12:
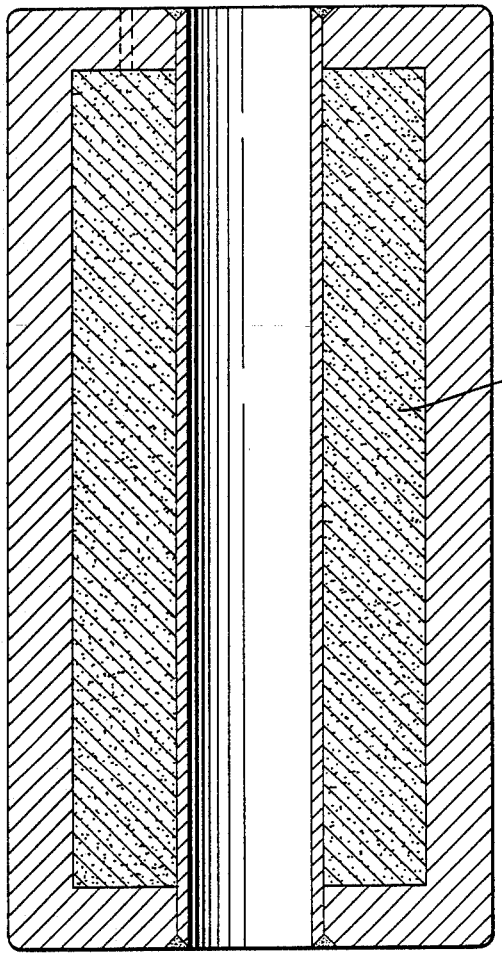

In the same way as in Example 20 compound tubes were produced but having the hard alloy 26 on the inside, see FIG. 12.

EXAMPLE 22

Figure 13:
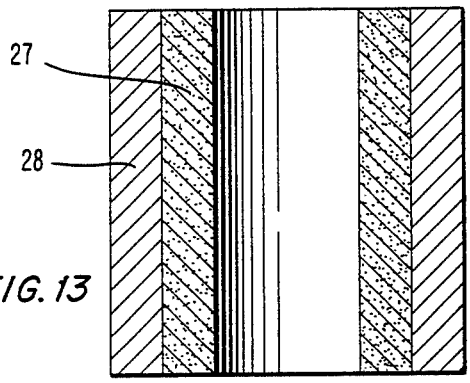

By simultaneous filling of powder according to the principle "sliding form", there were produced via cold isostatic pressing compound preforms for powder forging having hard alloy powder 27 innermost and steel powder 28 outermost, see FIG. 13.

We claim:

1. A compound body of at least two parts, one of said at least two parts being a wear-resistant surface consisting essentially of a hard material of from 30 to 70 volume percent of particles selected from the group consisting of carbides, nitrides, carbonitrides and mixtures thereof of metals selected from the group consisting of Ti, Zr, Hf, V, Nb, Ta, Cr, Mo, W and mixtures thereof, in a matrix based on a metal selected from the group consisting of Fe, Ni, Co and mixtures thereof, and another of said at least two parts being a supporting surface consisting essentially of high speed steel or tool steel, the thickness of the wear-resistant surface being from 3 to 50% of the radial dimension of the said compound body.

2. Compound body according to claim 1 characterized in that the matrix of the hard material is based upon iron.

3. Compound body according to claim 1 characterized in that the thickness of the hard material part is at least 0.5 mm.

4. Compound body according to claim 1 characterized in that the material of the supporting surface has a grindability which is at least six times better than the corresponding grindability of the material of the wear-resistant surface.

5. Compound body according to claim 1 characterized in that the grindability of the compound body and of the hard material alone, respectively as measured in relative grinding wheel wear ($mm^3$ work material/$mm^3$ grinding wheel wear) is usually greater than 5 and smaller than 1, respectively.

6. Compound body according to claim 1 characterized in that the hard material consists essentially of an alloy having 30–70% by volume of hard materials consisting essentially of titanium nitride in a matrix of high speed steel type including, normally present carbide types in which the hard materials have a grain size of $<1$ $\mu$m.

7. Compound body according to claim 1 wherein the hardness and toughness properties of the hard material is between those of cemented carbide and steel.

8. Compound body according to claim 1 wherein the thickness of the hard material is 10 to 20% of the radial dimension of the body.

9. Compound body according to claim 6 wherein the hard materials have a grain size less than 0.5 m.

10. Compound body according to claim 1 wherein the wear-resistant surface is in the form of a cutting surface and the supporting surface consists essentially of a high speed steel.

11. Compound body according to claim 1 wherein the body has a hole throughout said body.

12. Compound body according to claim 11 wherein the said wear-resistant surface is disposed along at least a portion of said hole.

13. Method of making a compound body according to claim 1, characterized in that a body of high speed steel or tool steel is placed in a powder mixture consisting of 30–70 by volume of hard constituents formed by particles selected from the group consisting of carbides, nitrides and carbonitrides and mixtures thereof of a metal selected from the group consisting of Ti, Zr, Hf, V, Nb, Ta, Cr, Mo, W and mixtures thereof in a matrix based on a metal selected from the group consisting of Fe, Ni, Co, and mixtures thereof after which the body and the powder mixture are compacted by cold isostatic pressing to form an extrusion billet, which then is placed in a can and hot extruded to a compound body blank.

14. Method of making a compound body according to, claim 1 characterized in that a body of steelpowder is made by cold isostatic compaction, the body or a solid steel body is placed in a cold isostatic tool where the remaining space is filled with a powder mixture consisting of 30–70% by volume of hard particles in a matrix based on a metal selected from the group consisting of Fe, Ni, Co and mixtures thereof after which the body and the powder mixture are compacted by cold isostatic compaction to forgings which are forged to a compounds body blank.

15. Method of making the compound body of claim 13 in which at least part of the exterior surface of the compound body blank is composed of the hard constituents.

16. Method of making the compound body of claim 14 in which at least part of the exterior surface of the compound body blank is composed of the hard constituents.

* * * * *